US010381146B2

(12) United States Patent
Noya

(10) Patent No.: US 10,381,146 B2
(45) Date of Patent: Aug. 13, 2019

(54) ELECTRONIC COMPONENT

(71) Applicant: MURATA MANUFACTURING CO., LTD., Kyoto-fu (JP)

(72) Inventor: Sunao Noya, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 26 days.

(21) Appl. No.: 15/477,653

(22) Filed: Apr. 3, 2017

(65) Prior Publication Data

US 2017/0309386 A1 Oct. 26, 2017

(30) Foreign Application Priority Data

Apr. 26, 2016 (JP) ..... 2016-087677

(51) Int. Cl.
*H01F 27/28* (2006.01)
*H01F 17/04* (2006.01)
*H01F 27/29* (2006.01)

(52) U.S. Cl.
CPC ..... *H01F 17/045* (2013.01); *H01F 27/2828* (2013.01); *H01F 27/292* (2013.01)

(58) Field of Classification Search
CPC ..... H01F 27/2828; H01F 27/292
USPC ..... 336/83, 90, 192, 200, 232
See application file for complete search history.

(56) References Cited

U.S. PATENT DOCUMENTS 4,635,019 A * 1/1987 Akachi ..... H01F 27/28 336/180
4,841,407 A * 6/1989 Baba ..... G11B 11/10508 361/146
9,349,526 B2 5/2016 Takagi et al.
2003/0043007 A1* 3/2003 Ishizuka ..... H01F 27/2823 336/182
2008/0024250 A1* 1/2008 Park ..... H01F 37/00 333/24 C
2014/0292465 A1 10/2014 Takagi et al.

FOREIGN PATENT DOCUMENTS

CN 104078198 A 10/2014
CN 204407125 U 6/2015
JP S62-45808 U 3/1987
JP H01-173701 A 7/1989
(Continued)

OTHER PUBLICATIONS

An Office Action mailed by the State Intellectual Property Office of the People's Republic of China dated Jul. 3, 2018, which corresponds to Chinese Patent Application No. 201710085817.7 and is related to U.S. Appl. No. 15/477,653.
(Continued)

*Primary Examiner* — Tszfung J Chan
(74) *Attorney, Agent, or Firm* — Studebaker & Brackett PC

(57) ABSTRACT

An electronic component includes a core, a first outer electrode, a second outer electrode, one or more third outer electrodes, and a wire electrically connecting the first outer electrode, the third electrodes, and the second outer electrode in series in that order. The wire forms a first inductor by being wound on the core between the first outer electrode and one of the third electrodes, and also forms a second inductor by being wound on the core between one of the third outer electrodes and the second outer electrode.

16 Claims, 16 Drawing Sheets

(56) References Cited

FOREIGN PATENT DOCUMENTS

| | | | | | |
|---|---|---|---|---|---|
| JP | 05304027 | A | * | 11/1993 | |
| JP | 08031644 | A | * | 2/1996 | |
| JP | H08-031644 | A | | 2/1996 | |
| JP | H11-111541 | A | | 4/1999 | |
| JP | H11-283835 | A | | 10/1999 | |
| JP | 2003109823 | A | * | 4/2003 | ..... H01F 17/045 |
| JP | 2007-180073 | A | | 7/2007 | |
| JP | 2014-82343 | A | | 5/2014 | |
| JP | 2014-197591 | A | | 10/2014 | |
| JP | 2014197591 | A | * | 10/2014 | ..... H01F 27/292 |

OTHER PUBLICATIONS

An Office Action mailed by the Japanese Patent Office dated Oct. 2, 2018, which corresponds to Japanese Patent Application No. 2016-087677 and is related to U.S. Appl. No. 15/477,653.

An Office Action; "Notification of Reasons for Refusal," Mailed by the Japanese Patent Office dated Feb. 19, 2019, which corresponds to Japanese Patent Application No. 2016-087677 and is related to U.S. Appl. No. 15/477,653 ; with English language translation.

* cited by examiner

11:11a-11c
12:12a, 12b

ELECTRONIC COMPONENT

CROSS REFERENCE TO RELATED APPLICATIONS

This application claims benefit of priority to Japanese Patent Application 2016-087677 filed Apr. 26, 2016, the entire content of which is incorporated herein by reference.

TECHNICAL FIELD

The present disclosure relates to electronic components, and particularly relates to an electronic component including an inductor.

BACKGROUND

As a disclosure relating to existing electronic components, for example, a wire-wound electronic component disclosed in Japanese Unexamined Patent Application Publication No. 2014-82343 is known. The stated wire-wound electronic component includes a core, a winding wire, a first outer electrode, and a second outer electrode. The core includes a winding core portion, a first flange, and a second flange. The winding core portion is formed substantially in a rod shape extending in a predetermined direction. The first flange is provided at one end of the winding core portion, and is formed substantially in a plate shape. The second flange is provided at the other end of the winding core portion, and is formed substantially in a plate shape. The first and second outer electrodes are provided on the first and second flanges, respectively. The winding wire is wound on the winding core portion. One end of the winding wire is connected to the first flange. The other end of the winding wire is connected to the second flange. In the wire-wound electronic component described above, the first and second outer electrodes are respectively mounted on land electrodes of a circuit board by soldering.

SUMMARY

In the case where a plurality of wire-wound electronic components are mounted on a circuit board, because the plurality of wire-wound electronic components respectively occupy different mounting portions in the circuit board, there arises a problem that an area needed for component mounting becomes large.

An object of the present disclosure is to provide an electronic component capable of reducing a mounting area.

An electronic component according to an embodiment of the present disclosure includes a core, a first outer electrode, a second outer electrode, one or more third outer electrodes, and a wire electrically connecting the first outer electrode, the third electrodes, and the second outer electrode in series in that order. The wire forms a first inductor by being wound on the core between the first outer electrode and one of the third electrodes, and also forms a second inductor by being wound on the core between one of the third outer electrodes and the second outer electrode.

According to some embodiments of the present disclosure, the mounting area can be reduced.

Other features, elements, characteristics and advantages of the present disclosure will become more apparent from the following detailed description with reference to the attached drawings.

DETAILED DESCRIPTION

Configuration of Electronic Component

Figure 1:
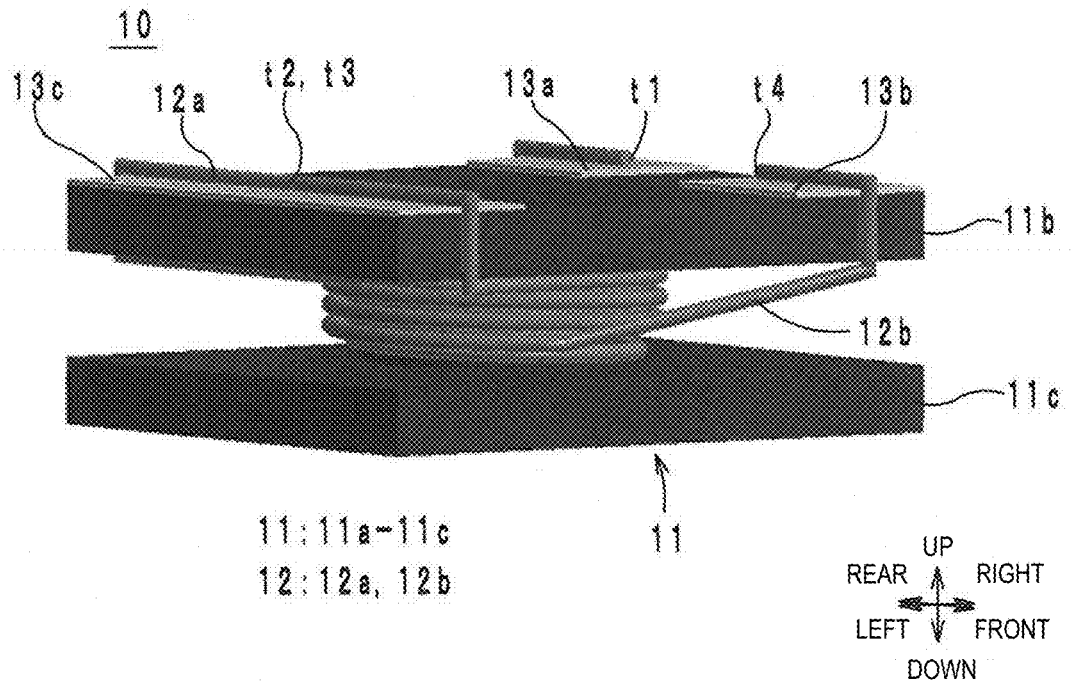
FIG. 1 is an exterior appearance perspective view of an electronic component according to an embodiment.
Figure 2:
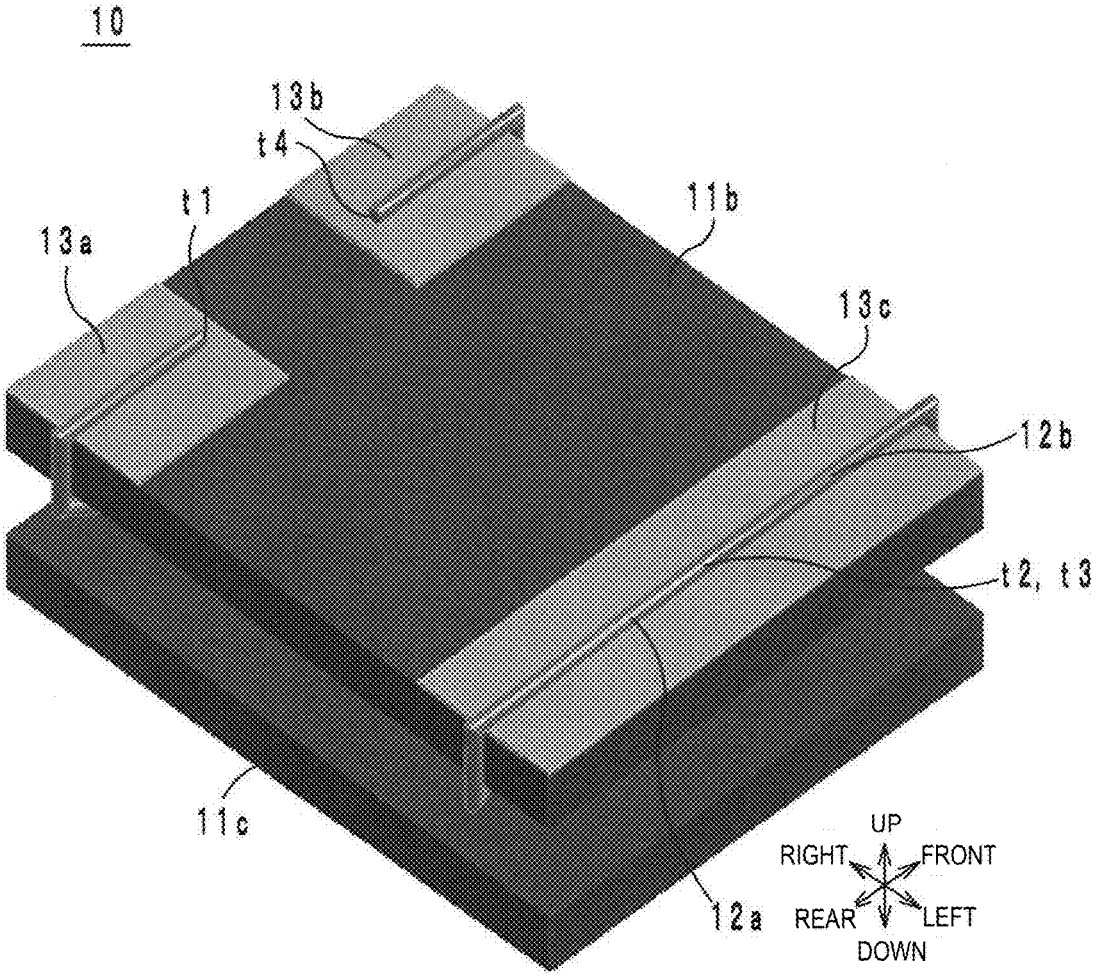
FIG. 2 is also an external appearance perspective view of the electronic component according to an embodiment.
Figure 3:
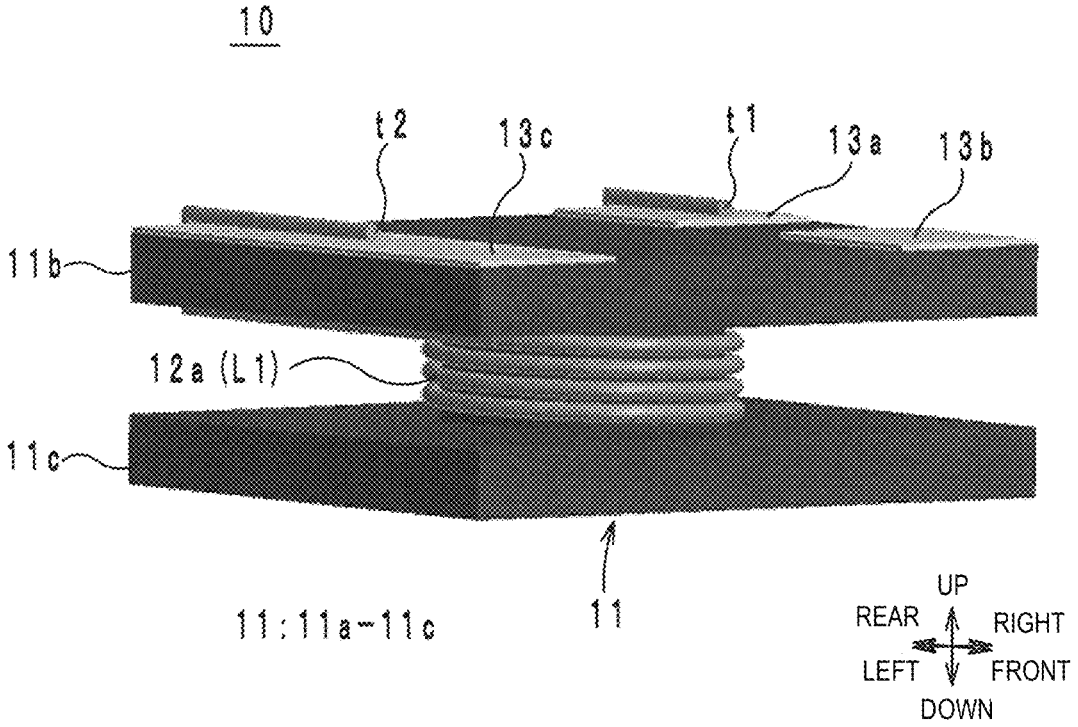
FIG. 3 is a schematic perspective view of the electronic component according to an embodiment.
Figure 4:
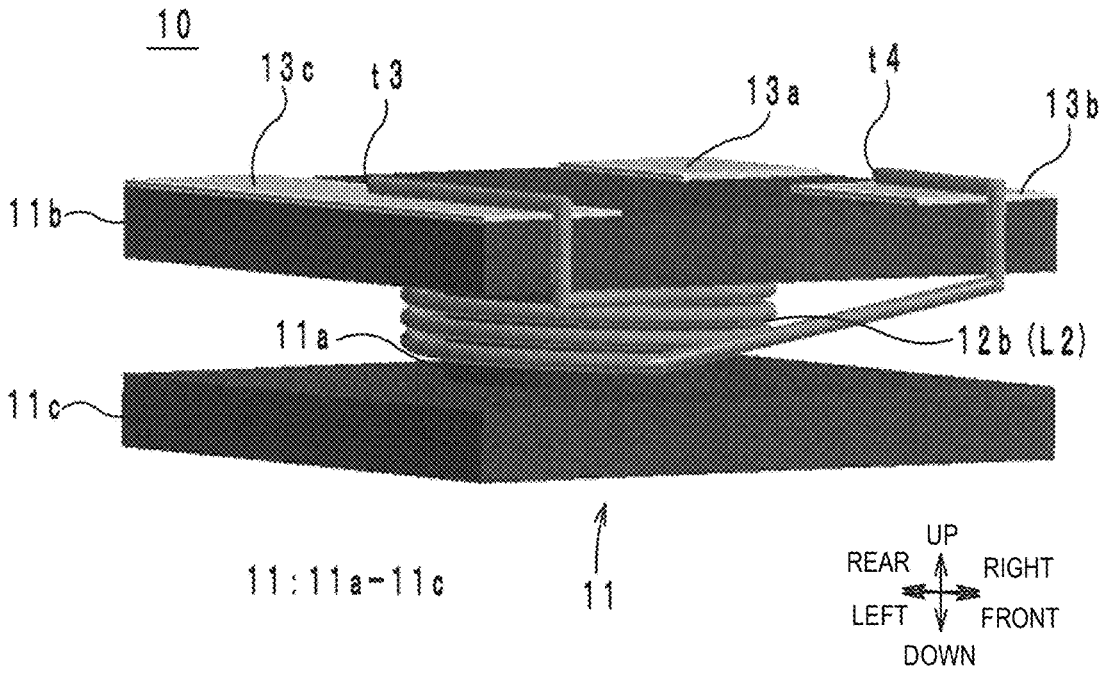
FIG. 4 is also a schematic perspective view of the electronic component according to an embodiment.
Figure 5:
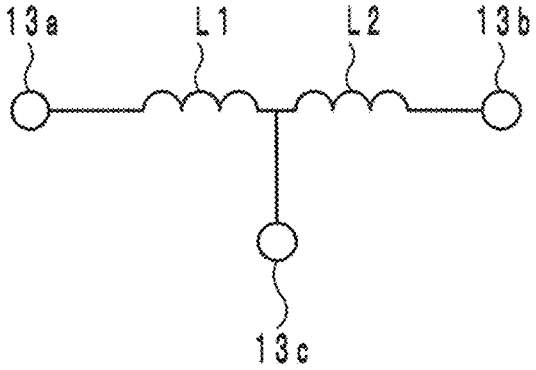
FIG. 5 is an equivalent circuit diagram of the electronic component.

The configuration of a coil component according to an embodiment will be described with reference to the drawings. FIGS. 1 and 2 are exterior appearance perspective views of an electronic component 10 according to an embodiment. FIGS. 3 and 4 are schematic perspective views of the electronic component 10 according to an embodiment. Note that, in FIG. 3, only an inductor portion 12*a* (inductor L1) within the wire 12 is illustrated. In FIG. 4, only an inductor portion 12*b* (inductor L2) within the wire 12 is illustrated. FIG. 5 is an equivalent circuit diagram of the electronic component 10. Hereinafter, a direction in which a center axis of each of the inductors L1 and L2 of the electronic component 10 extends is defined as an up-down direction. Further, a direction in which a long side of a flange 11*b* of the electronic component 10 extends when viewed from above, is defined as a right-left direction, and a direction in which a short side of the flange 11*b* of the electronic component 10 extends when viewed from above, is defined as a front-rear direction. The up-down direction, the right-left direction, and the front-rear direction are orthogonal to one another. It is unnecessary that the up-down direction, the right-left direction, and the front-rear direction defined above match an up-down direction, a right-left direction, and a front-rear direction at a time when the electronic component 10 is in use.

As shown in FIGS. 1 through 4, the electronic component includes a core 11, the wire 12, and outer electrodes 13*a*, 13*b*, and 13*c*. The core 11 includes a core portion 11*a* (hidden by the wire 12 in FIGS. 1 through 3), the flange 11*b*, and a flange 11*c*.

As shown in FIG. 4, the core portion 11*a* is a substantially cylinder-shaped member extending along the up-down direction (an example of a first direction). However, the core portion 11*a* is not limited to a cylinder shape, and may be formed substantially in a quadrangular prism shape, a polygonal column shape, or the like. The flange 11*b* is provided on an upper end of the core portion 11*a*, and is a plate member formed in a substantially rectangular shape when viewed from above. The long side of the flange 11*b* extends in the right-left direction when viewed from above. The short side of the flange 11*b* extends in the front-rear direction when viewed from above. With this, the flange 11*b* stretches out from the core portion 11*a* in the front-rear direction (the front-rear direction is an example of a second direction, and the front side thereof is an example of one side of the second direction) and in the right-left direction. The flange 11*c* is provided on a lower end of the core portion 11*a*, and is a plate member formed in a substantially rectangular shape when viewed from above. With this, the flange 11*c* is provided at a position distanced toward a lower side relative to the flange 11*b* (an example of a first side of the first direction). A long side of the flange 11*c* stretches out in the right-left direction when viewed from above. A short side of the flange 11*c* stretches out in the front-rear direction when viewed from above. With this, the flange 11*c*, like the flange 11*b*, stretches out from the core portion 11*a* in the front-rear direction (the front-rear direction is an example of the second direction, and the front side thereof is an example of one side of the second direction) and in the right-left direction. It is unnecessary that a long side direction (short side direction) of a principal surface of the flange 11*b* match a long side direction (short side direction) of a principal surface of the flange 11*c*. The core 11 is formed of a magnetic material such as ferrite or the like.

As shown in FIG. 2, the outer electrodes 13*a*, 13*b*, and 13*c* are substantially rectangular conductors when viewed from above, and are provided on an upper surface of the flange 11*b* (an example of a first mounting surface positioned on a second side of the first direction). The outer electrode 13*a* (an example of a first outer electrode) is so provided as to be in contact with a rear-right corner on the upper surface of the flange 11*b*. The outer electrode 13*b* (an example of a second outer electrode) is so provided as to be in contact with a front-right corner on the upper surface of the flange 11*b*. The outer electrode 13*c* (an example of a third outer electrode) is so provided as to extend along a long side on the left side of the upper surface of the flange 11*b*. The outer electrodes 13*a*, 13*b*, and 13*c* are electrically connected, when the electronic component 10 is mounted on a circuit board, to land electrodes on the circuit board side by soldering or the like. Accordingly, the upper surface of the flange 11*b* is a mounting surface opposing the circuit board. The materials of the above-discussed outer electrodes 13*a*, 13*b*, and 13*c* are a Ni-based alloy of Ni—Cr, Ni—Cu, Ni or the like, and Ag, Cu, Sn or the like.

The wire 12 is a conductive wire which is so constituted that a conductive core wire such as Cu or the like is covered with an insulative material such as polyurethane or the like, and is formed in a substantially circular cross-section shape. However, the wire 12 may be a rectangular wire formed in a substantially rectangular cross-section shape. The wire 12 electrically connects the outer electrode 13*a*, the outer electrode 13*c*, and the outer electrode 13*b* in series in that order. To be more specific, the wire 12 includes the inductor portions 12*a* and 12*b*. The inductor portion 12*a* (an example of a first inductor portion) includes end portions t1 and t2. The inductor portion 12*b* (an example of a second inductor portion) includes end portions t3 and t4. The end portion t2 of the inductor portion 12*a* and the end portion t3 of the inductor portion 12*b* are connected to each other. Further, the core wire of the wire 12 and the outer electrode 13 are electrically connected at the end portions t2 and t3 by the insulative material being removed. As such, the end portions t2 and t3 are a section in the outer electrode 13*c* where the insulative material is removed and the core wire is exposed. Although, in FIGS. 1 and 2, the end portions t2 and t3 are arranged at the same position of the wire 12, they are not limited thereto and may respectively be arranged at different positions of the wire in the case where, for example, there are a plurality of sections in which the insulative material is removed and the core wire is exposed in the outer electrode 13*c*.

The core wire of the wire 12 and the outer electrode 13*a* are electrically connected by the insulative material being removed at the end portion t1. The core wire of the wire 12 and the outer electrode 13*b* is electrically connected by the insulative material being removed at the end portion t4. As such, the end portions t1 and t4 are sections where the insulative material is removed and the core wire is exposed in the outer electrodes 13*a* and 13*b*, respectively.

Further, as shown in FIG. 3, the inductor portion 12*a* of the wire 12 forms the inductor L1 (an example of the first inductor) by being wound on the core portion 11*a* (core 11) between the outer electrode 13*a* and the outer electrode 13*c*. In the present embodiment, the inductor portion 12*a* is extended from the outer electrode 13*a* and then wound on the core portion 11*a* so as to form a substantially helical shape extending from the upper side to the lower side while turning in a counterclockwise direction when viewed from above. Further, the inductor portion 12*a*, after reaching the lower end of the core portion 11*a*, is extended onto the outer electrode 13*c*. The number of turns of the inductor portion 12*a* is about four, for example.

As shown in FIGS. 1 and 4, the inductor portion 12*b* of the wire 12 (an example of the second inductor portion) forms the inductor L2 by being wound on the core portion 11*a* (core 11) between the outer electrode 13*c* and the outer electrode 13*b*. In the present embodiment, the inductor portion 12*b* is extended from the outer electrode 13*c* and then wound on the core portion 11*a* so as to form a substantially helical shape extending from the upper side to the lower side while turning in the counterclockwise direction when viewed from above. At this time, since the inductor portion 12*a* has already been wound on the core portion 11*a*, the inductor portion 12*b* (inductor L2) is wound on the inductor portion 12*a* (inductor L1) which is wound on the core portion 11*a*. Further, the inductor portion 12*b*, after reaching the lower end of the core portion 11*a*, is extended onto the outer electrode 13*b*. The number of turns of the inductor portion 12*b* is about three, for example. In this manner, the number of turns of the inductor portion 12*b* is smaller than that of the inductor portion 12*a*. This makes an inductance value of the inductor L1 differ from an inductance value of the inductor L2. In the present embodiment, the inductance value of the inductor L2 is smaller than that of the inductor L1. Note that, however, the relationship between the number of turns of the inductor L1 and the number of turns of the inductor L2 is not limited thereto. Likewise, the relationship between the inductance value of the inductor L1 and the inductance value of the inductor L2 is not limited thereto.

The electronic component 10 constituted as discussed above has an equivalent circuit structure as shown in FIG. 5. More specifically, the inductors L1 and L2 are electrically connected in series in that order between the outer electrode 13*a* and the outer electrode 13*b*. The outer electrode 13*c* is connected between the inductor L1 and the inductor L2.

Manufacturing Method for Electronic Component

A manufacturing method for the electronic component 10 constituted as discussed above will be described hereinafter.

First, the core 11 is prepared. Next, a metal film of a Ni-based alloy of Ni—Cr, Ni—Cu, Ni or the like, and a metal film of Ag, Cu, Sn or the like are sequentially deposited using a mask so as to form the outer electrodes 13*a*, 13*b*, and 13*c* on the upper surface of the flange 11*b*. As a method for depositing the metal films, a sputtering technique, a printing technique, or the like can be cited, for example.

Next, as shown in FIG. 3, the inductor portion 12*a* of the wire 12 is wound on the core portion 11*a*. Subsequently, the end portion t1 of the inductor portion 12*a* is extended onto the outer electrode 13*a*, and the end portion t2 of the inductor portion 12*a* is extended onto the outer electrode 13*c*.

Next, as shown in FIG. 4, the inductor portion 12*b* is extended from the upper portion of the outer electrode 13*c* down to the core portion 11*a*. Thereafter, the inductor portion 12*b* of the wire 12 is wound on the core portion 11*a*. Then, the end portion t4 of the inductor portion 12*b* is extended onto the outer electrode 13*b*.

Next, the end portion t1 of the inductor portion 12*a* is pressed onto the outer electrode 13*a* while being heated using a heated jig. With this, the insulative material at the end portion t1 is removed so that the core wire is exposed and the end portion t1 is pressure-bonded to the outer electrode 13*a*. As a result, the end portion t1 of the inductor portion 12*a* and the outer electrode 13*a* are electrically connected. By carrying out the same process, the end portion t4 of the inductor portion 12*b* and the outer electrode 13*b* are electrically connected, and the end portions t2 and t3 and the outer electrode 13*c* are electrically connected. Note that the pressure bonding between the end portions t1 to t4 and the outer electrodes 13*a* to 13*c* may be carried out by radiating a laser beam instead of using the heated jig. Further, the connection between the end portions t1 to t4 and the outer electrodes 13*a* to 13*c* may be carried out by soldering. Through experiencing the above-described processes, the electronic component 10 is completed.

Effects

According to the electronic component 10, the mounting area can be reduced. To be more specific, in the case where the plurality of wire-wound electronic components disclosed in Japanese Unexamined Patent Application Publication No. 2014-82343 are mounted on a circuit board, because each of the plurality of wire-wound electronic components occupies a different mounting portion in the circuit board, there arises a problem that an area needed for component mounting becomes large. As such, in the electronic component 10, the inductor portion 12*a* as the inductor L1 and the inductor portion 12*b* as the inductor L2 are wound on the core portion 11*a*. With this, the electronic component 10 includes two inductors L1 and L2 in a single element; in addition, an inductance value of the inductor L1 can be obtained when the wiring connection is made between the outer electrode 13*a* and the outer electrode 13*c*, and the sum total of inductance values of the inductor L1 and the inductor L2 can be obtained when the wiring connection is made between the outer electrode 13*a* and the outer electrode 13*b*. As a result, the mounting area of the electronic component 10 is reduced.

Figure 6A:
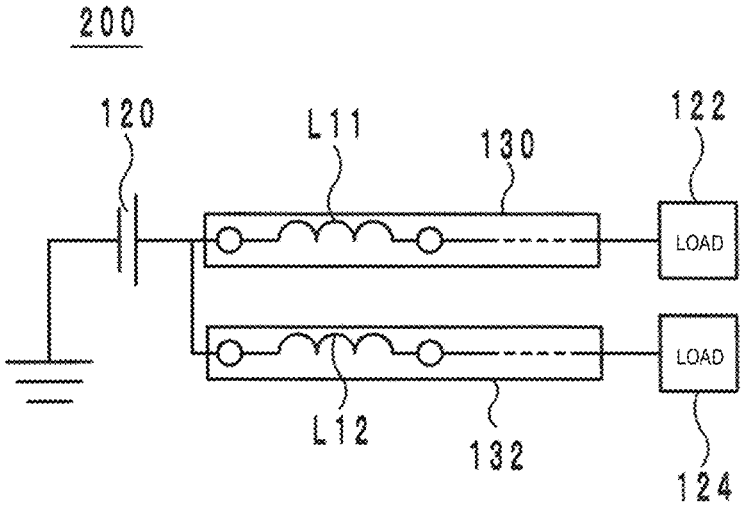
FIG. 6A is a block diagram of an electronic apparatus using an existing wire-wound electronic component.
Figure 6B:
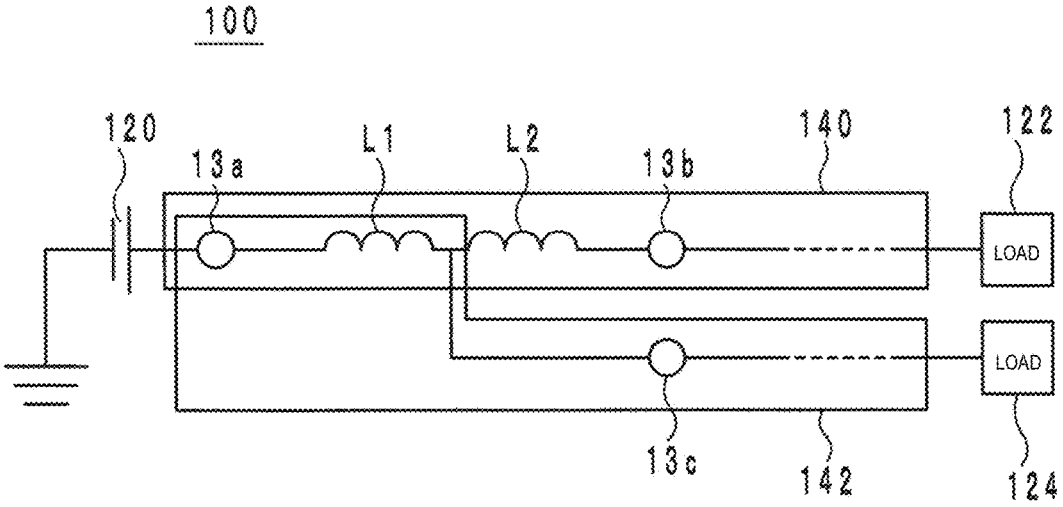
FIG. 6B is a block diagram of an electronic apparatus using the electronic component.

The electronic component 10 is used in a DC-DC converter, for example. Hereinafter, an example in which the electronic component 10 is used in a DC-DC converter is cited, whereby effects of the reduction in the mounting area of the electronic component 10 will be described in more detail. FIG. 6A is a block diagram of an electronic apparatus 200 using an existing wire-wound electronic component. FIG. 6B is a block diagram of an electronic apparatus 100 using the electronic component 10.

The electronic apparatus 200 includes, as shown in FIG. 6A, a power supply 120, loads 122 and 124, and DC-DC converters 130 and 132. The power supply 120 outputs a predetermined voltage. Note that the loads 122 and 124 are driven at different voltages from each other. Accordingly, the predetermined voltage needs to be converted to two different voltages at which the loads 122 and 124 can respectively be driven. As such, the DC-DC converter 130 is provided between the power supply 120 and the load 122, and the DC-DC converter 132 is provided between the power supply 120 and the load 124. With this, two DC-DC converters 130 and 132 respectively include inductors L11 and L12, and output two different voltages, to the loads 122 and 124, at which the loads 122 and 124 can respectively be driven. In order to efficiently realize the above-mentioned electronic apparatus 200, two wire-wound electronic components having different inductance values need to be prepared. As an example, an inductance value needed for the inductor L11 is set to about 10 μH, while an inductance value needed for the inductor L12 is set to about 7 μH. In this case, a space to mount the two wire-wound electronic components respectively having the inductance values of about 10 μH and 7 μH is required, which prevents the miniaturization of the electronic apparatus 200.

Meanwhile, the electronic apparatus 100 includes, as shown in FIG. 6B, the power supply 120, the loads 122 and 124, and DC-DC converters 140 and 142. Because the power supply 120 and the loads 122, 124 have already been described, redundant description thereof will be omitted. As shown in FIG. 6B, the DC-DC converter 140 is provided between the power supply 120 and the load 122, and the DC-DC converter 142 is provided between the power supply 120 and the load 124. The DC-DC converter 140 includes the inductors L1 and L2. The DC-DC converter 142 includes the inductor L1. In order to realize the above-mentioned electronic apparatus 100, an inductance value of the inductor L1 may be set to about 7 μH, while an inductance value of the inductor L2 may be set to about 3 μH in the electronic component 10. Then, the outer electrode 13*a* is electrically connected to the power supply 120, the outer electrode 13*b* is electrically connected to the load 122, and the outer electrode 13*c* is electrically connected to the load 124. With this, because the inductor L1 and the inductor L2 are connected in series between the power supply 120 and the load 122, an inductance value of about 10 μH is obtained. Meanwhile, the inductor L1 is connected between the power supply 120 and the load 124, an inductance value of about 7 μH is obtained. That is, in the electronic apparatus 100, the same circuit configuration as in the electronic apparatus 200 can be obtained. As discussed above, the electronic component 10, although its element is miniaturized, can exhibit the same function as in the case where two elements are used.

Further, in the electronic component 10, three different inductance values can be obtained using a single component. More specifically, in the electronic component 10, the inductance value of the inductor L1 and the inductance value of the inductor L2 are different from each other. With this, a combined inductance value of the inductors L1 and L2 (for example, about 10 μH) is obtained between the outer electrode 13*a* and the outer electrode 13*b*. The inductance value of the inductor L1 (for example, about 7 μH) is obtained between the outer electrode 13*a* and the outer electrode 13*c*.

Between the outer electrode 13*c* and the outer electrode 13*b*, the inductance value of the inductor L2 (for example, about 3 μH) is obtained. As discussed above, although the electronic component 10 has only two inductors L1 and L2, three different inductance values can be obtained. In the case where it is sufficient that two different inductance values are provided or the like, the inductors L1 and L2 may have the same inductance value.

Moreover, in the electronic component 10, the structure stability of the inductor portion 12*b* is improved. More specifically, in the electronic component 10, the inductor portion 12*b* is wound on the core portion 11*a*, on which the inductor portion 12*a* has been wound, while overlying the inductor portion 12*a*. In addition, the number of turns of the inductor portion 12*b* is smaller than that of the inductor portion 12*a*. This suppresses a situation where the inductor portion 12*b* stretches out from the inductor portion 12*a* in the up-down direction. As a result, looseness in the winding wire, disconnection, and instability of the characteristics due to the inductor portion 12*b* dropping from the inductor portion 12*a* onto the core portion 11*a* are suppressed, thereby improving the structure stability. Note that, however, even if the structure is such that the inductor portion 12*b* drops from the inductor portion 12*a* onto the core portion 11*a*, the inductor portion 12*b* can be stably formed and the number of turns of the inductor portion 12*b* may be equal to or greater than the number of turns of the inductor portion 12*a*.

First Variation

Figure 7:
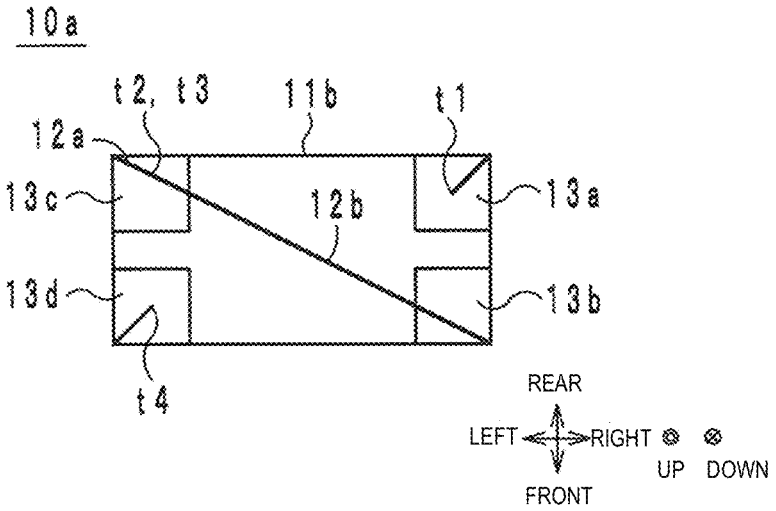
FIG. 7 is a view of an electronic component when seen from above.

Hereinafter, an electronic component 10*a* according to a first variation will be described with reference to the drawings. FIG. 7 is a view of the electronic component 10*a* when seen from above.

The electronic component 10*a* differs from the electronic component 10 in terms of arrangement of outer electrodes and arrangement of a wire 12. The electronic component 10*a* will be described below while focusing on the above-mentioned different points.

The electronic component 10*a* includes outer electrodes 13*a* to 13*d*. As shown in FIG. 7, the outer electrodes 13*a* to 13*d* are inductors each formed in a substantially rectangular shape when viewed from above, and are provided on an upper surface of a flange 11*b*. The outer electrode 13*a* is so provided as to be in contact with a rear-right corner on the upper surface of the flange 11*b*. The outer electrode 13*b* is so provided as to be in contact with a front-right corner on the upper surface of the flange 11*b*. The outer electrode 13*c* is so provided as to be in contact with a rear-left corner on the upper surface of the flange 11*b*. The outer electrode 13*d* is so provided as to be in contact with a front-left corner on the upper surface of the flange 11*b*.

An end portion t1 of an inductor portion 12*a* is connected to the outer electrode 13*a*. The inductor portion 12*a* is extended from the rear-right corner of the flange 11*b* to a core portion 11*a*, and then is wound on the core portion 11*a*.

The inductor portion 12*a* is extended from the rear-left corner of the flange 11*b* onto the upper surface of the flange 11*b*. An end portion t2 of the inductor portion 12*a* and an end portion t3 of an inductor portion 12*b* are connected to the outer electrode 13*c*. Further, the inductor portion 12*b* is extended, on the upper surface of the flange 11*b*, to the front-right corner. Then, the inductor portion 12*b* is extended from the front-right corner of the flange 11*b* to the core portion 11*a* and is wound on the core portion 11*a*.

Furthermore, the inductor portion 12*b* is extended from the front-left corner of the flange 11*b* onto the upper surface of the flange 11*b*. An end portion t4 of the inductor portion 12*b* is connected to the outer electrode 13*d*. Because other constituent elements of the electronic component 10*a* are the same as those of the electronic component 10, description thereof is omitted herein.

Also in the above-described electronic component 10*a*, the mounting area can be reduced for the same reason as in the case of the electronic component 10. Further, in the electronic component 10*a*, for the same reason as in the case of the electronic component 10, three different inductance values can be obtained using a single component. Moreover, in the electronic component 10*a*, the structure stability of the inductor portion 12*b* is improved for the same reason as in the case of the electronic component 10.

In the electronic component 10*a*, the wire 12 may be connected to the outer electrode 13*b* in addition to the outer electrode 13*c*, or may be connected to the outer electrode 13*b* in place of the outer electrode 13*c*. In particular, in the case where the wire 12 is connected to the outer electrode 13*b* in addition to the outer electrode 13*c*, the degree of freedom of a wiring pattern in the circuit board can be increased.

Second Variation

Figure 8:
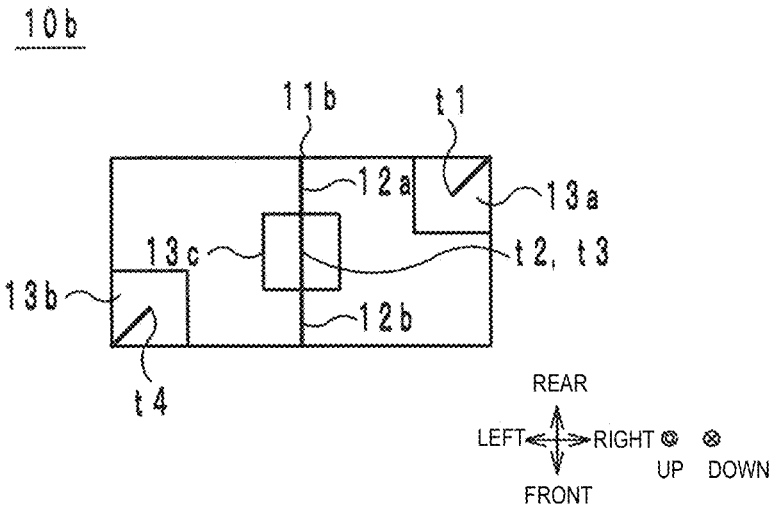
FIG. 8 is a view of an electronic component when seen from above.

Hereinafter, an electronic component 10*b* according to a second variation will be described with reference to the drawings. FIG. 8 is a view of the electronic component 10*b* when seen from above.

The electronic component 10*b* differs from the electronic component 10*a* in terms of arrangement of outer electrodes and arrangement of a wire 12. The electronic component 10*b* will be described below while focusing on the above-mentioned different points.

The electronic component 10*b* includes outer electrodes 13*a* to 13*c*. As shown in FIG. 8, the outer electrodes 13*a* to 13*c* are inductors each formed in a substantially rectangular shape when viewed from above, and are provided on an upper surface of a flange 11*b*. The outer electrode 13*a* is so provided as to be in contact with a rear-right corner on the upper surface of the flange 11*b*. The outer electrode 13*b* is so provided as to be in contact with a front-left corner on the upper surface of the flange 11*b*. The outer electrode 13*c* is provided at the center of the upper surface of the flange 11*b* (an intersection point of diagonal lines).

An end portion t1 of an inductor portion 12*a* is connected to the outer electrode 13*a*. The inductor portion 12*a* is extended from the rear-right corner of the flange 11*b* to a core portion 11*a*, and then is wound on the core portion 11*a*.

The inductor portion 12*a* is extended from the center of a long side on the rear side of the flange 11*b* onto the upper surface of the flange 11*b*. An end portion t2 of the inductor portion 12*a* and an end portion t3 of an inductor portion 12*b* are connected to the outer electrode 13*c*. Further, the inductor portion 12*b* is extended, on the upper surface of the flange 11*b*, to the center of a long side on the front side. Then, the inductor portion 12*b* is extended from the center of the long side on the front side of the flange 11*b* to the core portion 11*a*, and is then wound on the core portion 11*a*.

Furthermore, the inductor portion 12*b* is extended from the front-left corner of the flange 11*b* onto the upper surface of the flange 11*b*. An end portion t4 of the inductor portion 12*b* is connected to the outer electrode 13*b*. Because other constituent elements of the electronic component 10*b* are the same as those of the electronic component 10*a*, description thereof is omitted herein.

Also in the above-described electronic component 10*b*, the mounting area can be reduced for the same reason as in the case of the electronic component 10*a*. Further, in the electronic component 10*b*, for the same reason as in the case of the electronic component 10*a*, three different inductance values can be obtained using a single component. Moreover, in the electronic component 10*b*, the structure stability of the inductor portion 12*b* is improved for the same reason as in the case of the electronic component 10*a*.

Third Variation

Figure 9:
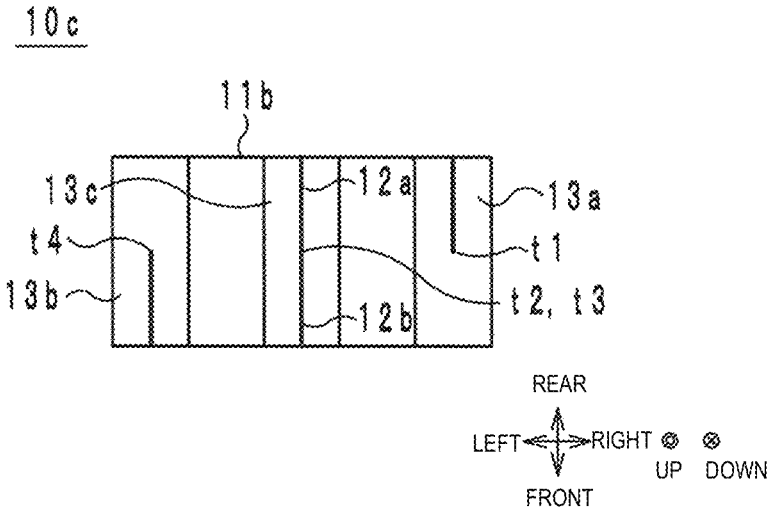
FIG. 9 is a view of an electronic component when seen from above.

Hereinafter, an electronic component 10*c* according to a third variation will be described with reference to the drawings. FIG. 9 is a view of the electronic component 10*c* when seen from above.

The electronic component 10*c* differs from the electronic component 10*b* in terms of arrangement of outer electrodes 13*a* to 13*c* and arrangement of a wire 12. The electronic component 10*c* will be described below while focusing on the above-mentioned different points.

The electronic component 10*c* includes the outer electrodes 13*a* to 13*c*. As shown in FIG. 9, the outer electrodes 13*a* to 13*c* are inductors each formed in a substantially rectangular shape when viewed from above, and are provided on an upper surface of a flange 11*b*. The outer electrode 13*a* is provided along a short side on the right side of the upper surface of the flange 11*b*. The outer electrode 13*b* is provided along a short side on the left side of the upper surface of the flange 11*b*. The outer electrode 13*c* is so provided as to extend in the front-rear direction between the center of a long side on the front side of the flange 11*b* and the center of a long side on the rear side thereof.

An end portion t1 of an inductor portion 12*a* is connected to the outer electrode 13*a*. The inductor portion 12*a* is extended from the vicinity of a right end of the long side on the rear side of the flange 11*b* to a core portion 11*a*, and then is wound on the core portion 11*a*.

The inductor portion 12*a* is extended from the center of the long side on the rear side of the flange 11*b* onto the upper surface of the flange 11*b*. Then, an end portion t2 of the inductor portion 12*a* and an end portion t3 of an inductor portion 12*b* are connected to the outer electrode 13*c*. Further, the inductor portion 12*b* extends, on the upper surface of the flange 11*b*, to the center of the long side on the front side. Then, the inductor portion 12*b* is extended from the center of the long side on the front side of the flange 11*b* to the core portion 11*a*, and then is wound on the core portion 11*a*.

Furthermore, the inductor portion 12*b* is extended from the vicinity of a left end of the long side on the front side of the flange 11*b* onto the upper surface of the flange 11*b*. An end portion t4 of the inductor portion 12*b* is connected to the outer electrode 13*b*. Because other constituent elements of the electronic component 10*c* are the same as those of the electronic component 10*b*, description thereof is omitted herein.

Also in the above-described electronic component 10*c*, the mounting area can be reduced for the same reason as in the case of the electronic component 10*b*. Further, in the electronic component 10*c*, for the same reason as in the case of the electronic component 10*b*, three different inductance values can be obtained using a single component. Moreover, in the electronic component 10*c*, the structure stability of the inductor portion 12*b* is improved for the same reason as in the case of the electronic component 10*b*.

Fourth Variation

Figure 10:
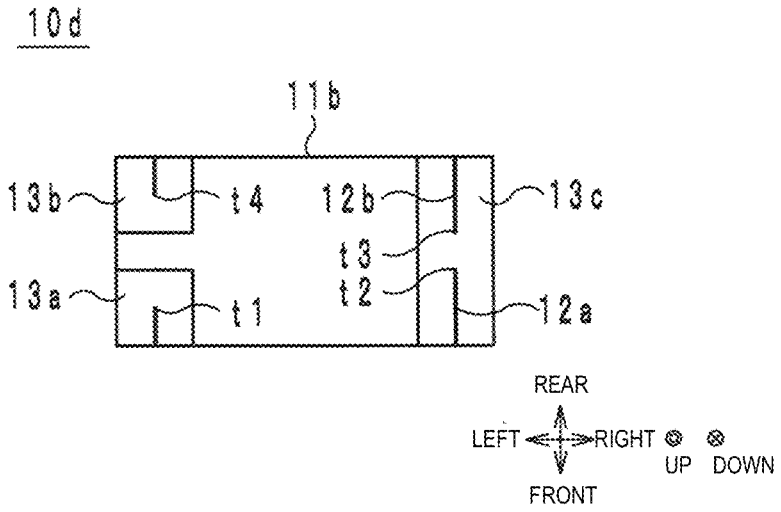
FIG. 10 is a view of an electronic component when seen from above.

Hereinafter, an electronic component 10*d* according to a fourth variation will be described with reference to the drawings. FIG. 10 is a view of the electronic component 10*d* when seen from above.

The electronic component 10*d* differs from the electronic component 10 in a point that a wire 12 is divided into two inductor portions 12*a* and 12*b*. The electronic component 10*d* will be described below while focusing on the above-mentioned different point.

In the electronic component 10*d*, an end portion t2 of the inductor portion 12*a* is not connected to an end portion t3 of the inductor portion 12*b*. However, the end portion t2 of the inductor portion 12*a* and the end portion t3 of the inductor portion 12*b* are both connected to an outer electrode 13*c*. With this, the wire 12 electrically connects an outer electrode 13*a*, the outer electrode 13*c*, and an outer electrode 13*b* in series in that order.

Also in the above-described electronic component 10*d*, the mounting area can be reduced for the same reason as in the case of the electronic component 10. Further, in the electronic component 10*d*, for the same reason as in the case of the electronic component 10, three different inductance values can be obtained using a single component. Moreover, in the electronic component 10*d*, the structure stability of the inductor portion 12*b* is improved for the same reason as in the case of the electronic component 10.

Fifth Variation

Figure 11:
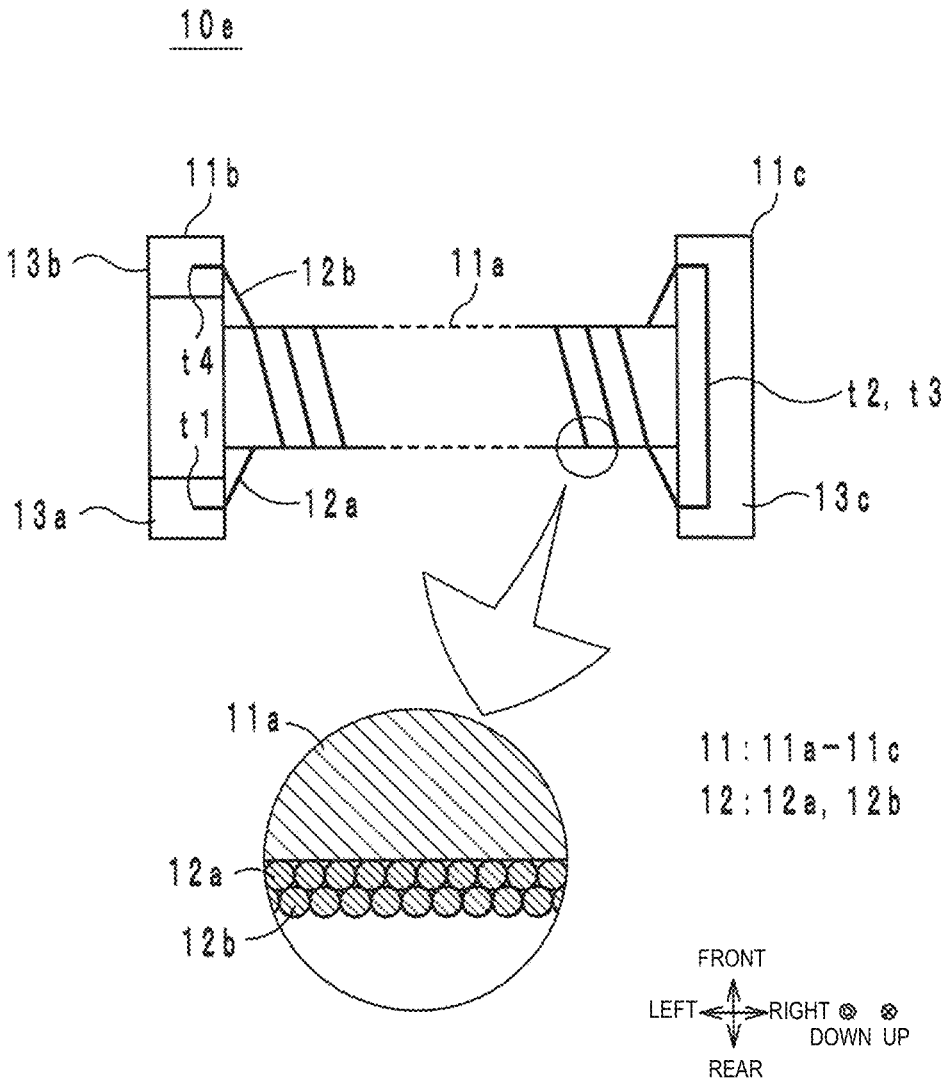
FIG. 11 is a view of an electronic component when seen from the bottom.
Figure 12:
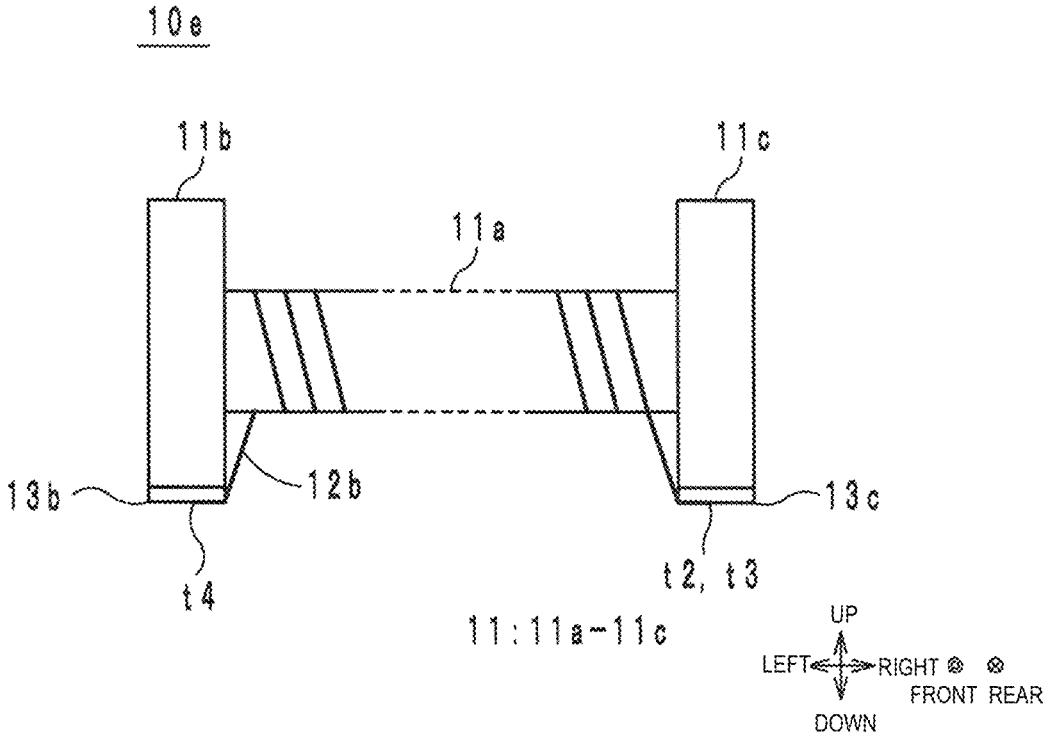
FIG. 12 is a view of the electronic component when seen from the front.

Hereinafter, an electronic component 10*e* according to a fifth variation will be described with reference to the drawings. FIG. 11 is a view of the electronic component 10*e* when seen from the bottom. An enlarged view in FIG. 11 is a cross-sectional view of a section enclosed by a circle. FIG. 12 is a view of the electronic component 10*e* when seen from the front.

In the electronic component 10, the center axis of each of the inductors L1 and L2 extends in the up-down direction. Meanwhile, in the electronic component 10*e*, a center axis of each of inductors L1 and L2 extends in the right-left direction. The electronic component 10*e* will be described below while focusing on the above-mentioned different point.

As shown in FIGS. 11 and 12, a core portion 11*a* is a substantially cylinder-shaped member extending along the right-left direction (an example of the first direction). A flange 11*b* is provided at a left end of the core portion 11*a*, and is a plate member formed in a substantially rectangular shape when viewed from above. The flange 11*b* stretches out from the core portion 11*a* in the up-down direction (the up-down direction is an example of the second direction, and the lower side thereof is an example of one side of the second direction) and in the front-rear direction. A flange 11*c* is provided at a right end of the core portion 11*a*, and is a plate member formed in a substantially rectangular shape when viewed from above. The flange 11*c* is provided at a position distanced toward the right side (an example of a first side of the first direction) relative to the flange 11*b*. Further, the flange 11*c*, like the flange 11*b*, stretches out from the core portion 11*a* in the up-down direction and in the front-rear direction.

As shown in FIG. 11, outer electrodes 13*a* and 13*b* are inductors each formed in a substantially rectangular shape when viewed from the bottom, and are provided on a lower surface of the flange 11*b* (an example of a second mounting surface positioned on one side of the second direction). The outer electrode 13*a* (an example of the first outer electrode) is so provided as to be in contact with a side on the rear side of the lower surface of the flange 11*b*. The outer electrode 13*b* (an example of the second outer electrode) is so provided as to be in contact with a side on the front side of the lower surface of the flange 11*b*. An outer electrode 13*c* (an example of the third outer electrode) is so provided as to cover the entirety of a lower surface of the flange 11*c* (an example of a third mounting surface positioned on one side of the second direction).

A wire 12 electrically connects the outer electrode 13*a*, the outer electrode 13*c*, and the outer electrode 13*b* in series in that order. To be more specific, the wire 12 includes inductor portions 12*a* and 12*b*. The inductor portion 12*a* includes end portions t1 and t2. The inductor portion 12*b* includes end portions t3 and t4. The core wire of the wire 12 and the outer electrode 13*c* are electrically connected at the end portions t2 and t3 by the insulative material being removed.

Further, by the insulative material being removed at the end portion t1, the core wire of the wire 12 and the outer electrode 13*a* are electrically connected. By the insulative material being removed at the end portion t4, the core wire of the wire 12 and the outer electrode 13*b* are electrically connected.

The inductor portion 12*a* of the wire 12 forms an inductor L1 by being wound on the core portion 11*a* (core 11) between the outer electrode 13*a* and the outer electrode 13*c*, as shown in FIGS. 11 and 12.

The inductor portion 12*b* of the wire 12 forms an inductor L2 by being wound on the core portion 11*a* (core 11) between the outer electrode 13*c* and the outer electrode 13*b*, as shown in FIGS. 11 and 12. Because the inductor portion 12*a* has already been wound on the core portion 11*a*, the inductor portion 12*b* is wound on the core portion 11*a*, on which the inductor portion 12*a* has been wound, while overlying the inductor portion 12*a*.

Also in the above-described electronic component 10*e*, the mounting area can be reduced for the same reason as in the case of the electronic component 10. Further, in the electronic component 10*e*, for the same reason as in the case of the electronic component 10, three different inductance values can be obtained using a single component. Moreover, in the electronic component 10*e*, the structure stability is improved for the same reason as in the case of the electronic component 10.

Sixth Variation

Figure 13:
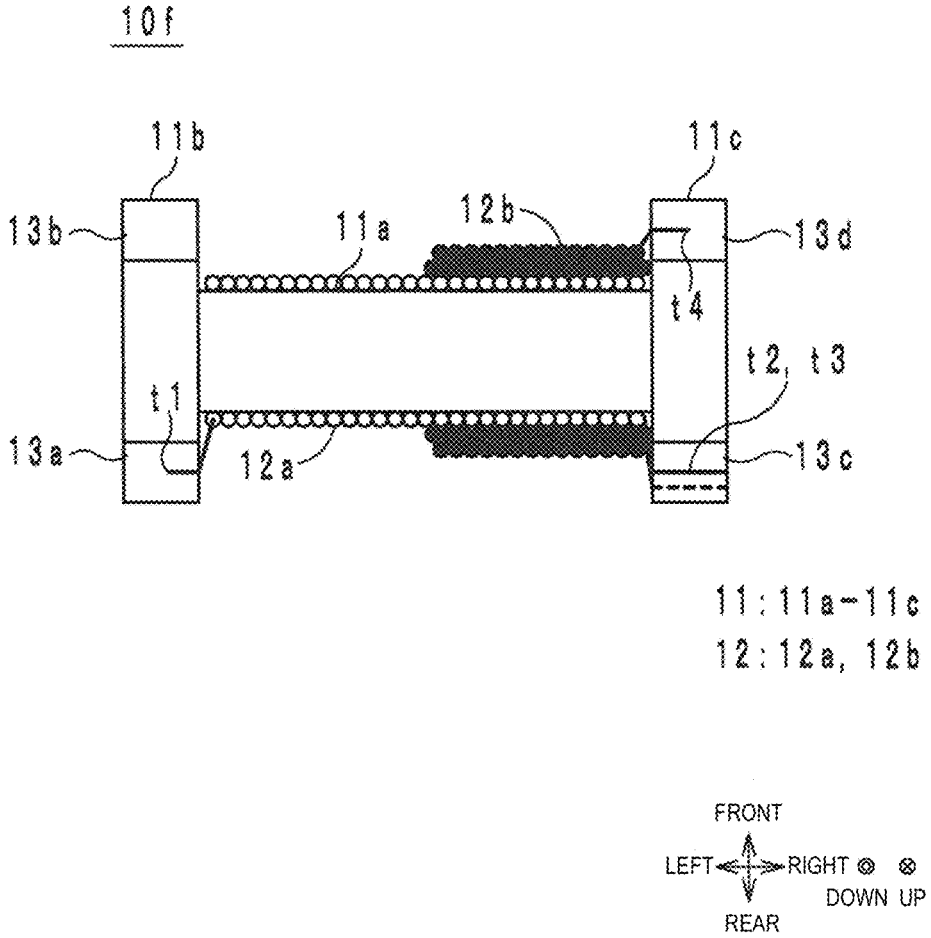
FIG. 13 is a view of an electronic component when seen from the bottom.

Hereinafter, an electronic component 10*f* according to a sixth variation will be described with reference to the drawings. FIG. 13 is a view of the electronic component 10*f* when seen from the bottom. In FIG. 13, a cross section structure of the core portion 11*a* is illustrated.

The electronic component 10*f* differs from the electronic component 10*e* in terms of arrangement of outer electrodes and arrangement of a wire 12. The electronic component 10*f* will be described below while focusing on the above-mentioned different points.

As shown in FIG. 13, outer electrodes 13*a* and 13*b* are conductors each formed in a substantially rectangular shape when viewed from above, and are provided on a lower surface of a flange 11*b*. The outer electrode 13*a* (an example of the first outer electrode) is so provided as to be in contact with a side on the rear side of the lower surface of the flange 11*b*. The outer electrode 13*b* is so provided as to be in contact with a side on the front side of the lower surface of the flange 11*b*.

As shown in FIG. 13, outer electrodes 13*c* and 13*d* are conductors each formed in a substantially rectangular shape when viewed from above, and are provided on a lower surface of a flange 11*c*. The outer electrode 13*c* (an example of the third outer electrode) is so provided as to be in contact with a side on the rear side of the lower surface of the flange 11*c*. The outer electrode 13*d* (an example of the second outer electrode) is so provided as to be in contact with a side on the front side of the lower surface of the flange 11*c*.

A wire 12 electrically connects the outer electrode 13*a*, the outer electrode 13*c*, and the outer electrode 13*d* in series in that order. To be more specific, the wire 12 includes inductor portions 12*a* and 12*b*. The inductor portion 12*a* includes end portions t1 and t2. The inductor portion 12*b* includes end portions t3 and t4. The core wire of the wire 12 and the outer electrode 13*c* are electrically connected at the end portions t2 and t3 by the insulative material being removed.

Further, by the insulative material being removed at the end portion t1, the core wire of the wire 12 and the outer electrode 13*a* are electrically connected. By the insulative material being removed at the end portion t4, the core wire of the wire 12 and the outer electrode 13*d* are electrically connected.

The inductor portion 12*a* of the wire 12 forms an inductor L1 by being wound on the core portion 11*a* (core 11) between the outer electrode 13*a* and the outer electrode 13*c*, as shown in FIG. 13.

As shown in FIG. 13, the inductor portion 12*b* of the wire 12 is extended from the outer electrode 13*c* to the core portion 11*a* through the right surface and upper surface of the flange 11*c*. A portion indicated by a dotted line in FIG. 13 represents the wire 12 passing through the upper surface of the flange 11*c*. Then, the inductor portion 12*b* is wound on the core portion 11*a*. However, since the inductor portion 12*a* has already been wound on the core portion 11*a*, the inductor portion 12*b* is wound on the core portion 11*a*, on which the inductor portion 12*a* has been wound, while overlying the inductor portion 12*a*. Further, the inductor portion 12*b*, after having proceeded from the vicinity of a right end of the core portion 11*a* to the center of the core portion 11*a* in the right-left direction, returns to the vicinity of the right end of the core portion 11*a* from the center of the core portion 11*a* in the right-left direction. In other words, the inductor portion 12*b* is wound double on a right half of the core portion 11*a*.

Also in the above-described electronic component 10*f*, the mounting area can be reduced for the same reason as in the case of the electronic component 10*e*. Further, in the electronic component 10*f*, for the same reason as in the case of the electronic component 10*e*, three different inductance values can be obtained using a single component. Further, in the electronic component 10*f*, a length in the right-left direction of a region where the inductor portion 12*a* is wound is longer than a region in the right-left direction of a region where the inductor portion 12*b* is wound. This suppresses a situation where the inductor portion 12*b* stretches out from the inductor portion 12*a* in the right-left direction. As a result, a situation where the inductor portion 12*b* drops from the inductor portion 12*a* onto the core portion 11*a* is suppressed, thereby improving the structure stability.

Seventh Variation

Figure 14:
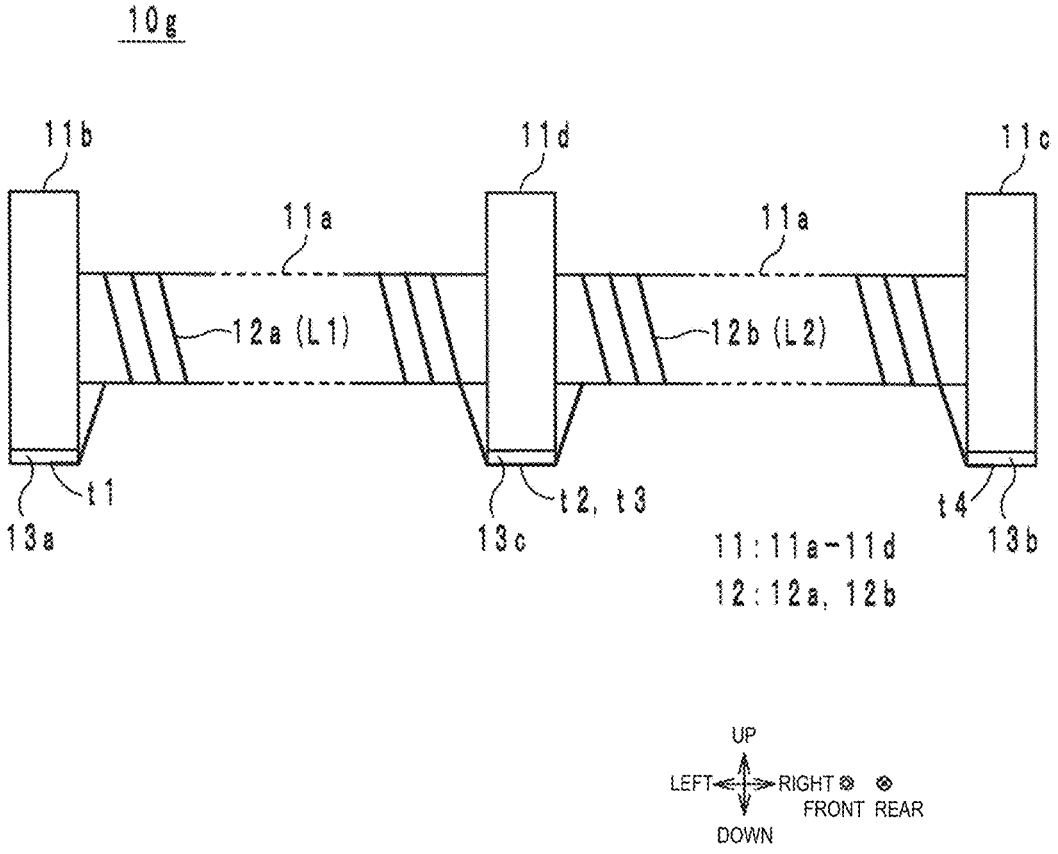
FIG. 14 is a view of an electronic component when seen from the front.

Hereinafter, an electronic component 10*g* according to a seventh variation will be described with reference to the drawings. FIG. 14 is a view of the electronic component 10*g* when seen from the front.

In the electronic component 10*e*, the inductor portion 12*b* is wound on the core portion 11*a*, on which the inductor portion 12*a* has been wound, while overlying the inductor portion 12*a*. In contrast, in the electronic component 10*g*, an inductor portion 12*b* is not wound overlying an inductor portion 12*a*. The electronic component 10*g* will be described below while focusing on the above different point.

A core 11 includes a core portion 11*a* and flanges 11*b* to 11*d*. As shown in FIG. 14, the core portion 11*a* is a substantially cylinder-shaped member extending along the right-left direction (an example of the first direction). The flange 11*b* (an example of a first flange) is a plate member formed in a substantially rectangular shape and is provided at a left end of the core portion 11*a*. The flange 11*b* stretches out from the core portion 11*a* in the up-down direction (the up-down direction is an example of the second direction, and the lower side thereof is an example of one side of the second direction) and in the front-rear direction. The flange 11*d* (an example of a third flange) is a plate member formed in a substantially rectangular shape and is provided at the center of the core portion 11*a* in the right-left direction. With this, the flange 11*d* is provided at a position distanced toward the right side relative to the flange 11*b* (an example of a first side of the first direction). In addition, the flange 11*d* stretches out from the core portion 11*a* in the up-down direction and in the front-rear direction. The flange 11*c* (an example of a second flange) is a plate member formed in a substantially rectangular shape and is provided at a right end of the core portion 11*a*. With this, the flange 11*c* is provided at a position distanced toward the right side relative to the flange 11*d*. Further, the flange 11*c* stretches out from the core portion 11*a* in the up-down direction and in the front-rear direction.

As shown in FIG. 14, an outer electrode 13*a* (an example of the first outer electrode) is provided on a lower surface of the flange 11*b* (an example of a fourth mounting surface positioned on one side of the second direction). An outer electrode 13*b* is, as shown in FIG. 14, provided on a lower surface of the flange 11*c* (an example of a fifth mounting surface positioned on one side of the second direction). An outer electrode 13*c* is, as shown in FIG. 14, provided on a lower surface of the flange 11*d* (an example of a sixth mounting surface positioned on one side of the second direction).

A wire 12 electrically connects the outer electrode 13*a*, the outer electrode 13*c*, and the outer electrode 13*b* in series in that order. To be more specific, the wire 12 includes inductor portions 12*a* and 12*b*. The inductor portion 12*a* includes end portions t1 and t2. The inductor portion 12*b* includes end portions t3 and t4. The core wire of the wire 12 and the outer electrode 13*c* are electrically connected at the end portions t2 and t3 by the insulative material being removed.

Further, by the insulative material being removed at the end portion t1, the core wire of the wire 12 and the outer electrode 13*a* are electrically connected. By the insulative material being removed at the end portion t4, the core wire of the wire 12 and the outer electrode 13*b* are electrically connected.

The inductor portion 12*a* of the wire 12 forms an inductor L1, between the outer electrode 13*a* and the outer electrode 13*c*, by being wound on a portion of the core portion 11*a* (core 11) between the flange 11*b* and the flange 11*d*, as shown in FIG. 14.

Further, the inductor portion 12*b* of the wire 12 forms an inductor L2, between the outer electrode 13*c* and the outer electrode 13*b*, by being wound on a portion of the core portion 11*a* (core 11) between the flange 11*d* and the flange 11*c*, as shown in FIG. 14.

Also in the above-described electronic component 10*g*, the mounting area can be reduced. More specifically, in the electronic component 10*g*, the inductor portion 12*a* and the inductor portion 12*b* are wound on the core portion 11*a* without overlapping with each other. This makes a length of the electronic component 10*g* in the right-left direction longer than that of the electronic component 10*e* in the right-left direction.

Note that, however, in the electronic component 10*g*, the end portions t2 and t3 are both connected to the outer electrode 13*c* provided on the flange 11*d*. Accordingly, only three flanges are needed in the electronic component 10*g*. On the other hand, four flanges are needed in the case where two wire-wound electronic components disclosed in Japanese Unexamined Patent Application Publication No. 2014-82343 are aligned. As such, in the electronic component 10*g*, the length in the right-left direction is shorter than in the case where two wire-wound electronic components disclosed in Japanese Unexamined Patent Application Publication No. 2014-82343 are used. As a result, the mounting surface is reduced in the electronic component 10*g* as well.

In addition, in the electronic component 10*g*, for the same reason as in the case of the electronic component 10*e*, three different inductance values can be obtained using a single component. Further, in the electronic component 10*g*, the structure stability of the inductor portion 12*b* is improved because the inductor portion 12*b* is not wound overlying the inductor portion 12*a*.

Eighth Variation

Figure 15:
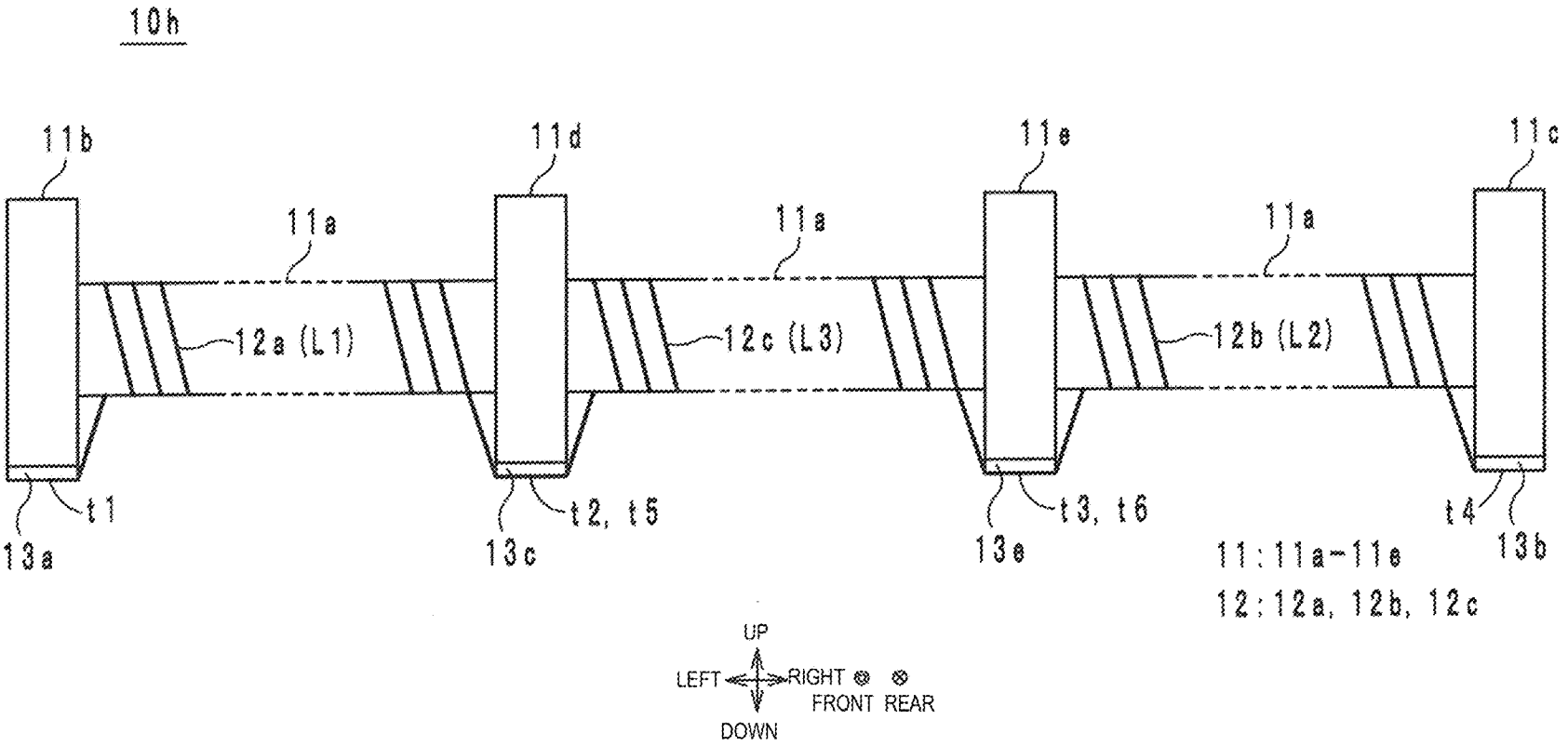
FIG. 15 is a view of an electronic component when seen from the front.

Hereinafter, an electronic component 10*h* according to an eighth variation will be described with reference to the drawings. FIG. 15 is a view of the electronic component 10*h* when seen from the front.

The electronic component 10*h* differs from the electronic component 10*g* in a point that an inductor L3 is further provided therein. The electronic component 10*h* will be described below while focusing on the above different point.

A core 11 further includes a flange 11*e* and an outer electrode 13*e*. The flange 11*e* is provided between a flange 11*d* and a flange 11*c*. With this, the flange 11*e* is provided at a position distanced toward the right side relative to the flange 11*d*. Further, the flange 11*e* stretches out from a core portion 11*a* in the up-down direction and in the front-rear direction. The outer electrode 13*e* is provided on a lower surface of the flange 11*e*.

A wire 12 electrically connects an outer electrode 13*a*, an outer electrode 13*c* as well as the outer electrode 13*e* (an example of one or more third outer electrodes), and an outer electrode 13*b* in series in that order. More specifically, the wire 12 includes inductor portions 12*a*, 12*c*, and 12*b* connected in series in that order. End portions t1 and t2 of the inductor portion 12*a* are connected to the outer electrodes 13*a* and 13*c*, respectively. End portions t5 and t6 of the inductor portion 12*c* are connected to the outer electrodes 13*c* and 13*e*, respectively. End portions t3 and t4 of the inductor portion 12*b* are connected to the outer electrodes 13*e* and 13*b*, respectively.

Also in the above-described electronic component 10*h*, the mounting area can be reduced for the same reason as in the case of the electronic component 10*g*. Further, in the electronic component 10*h*, the inductor portions 12*a*, 12*b*, and 12*c* are not wound overlapping with each other, thereby the structure stability thereof being improved for the same reason as in the case of the electronic component 10*g*.

In addition, in the electronic component 10*h*, seven different inductance values can be obtained using a single component. To be more specific, in the case where an inductance value of an inductor L1, an inductance value of an inductor L2, and an inductance value of the inductor L3 are different, the following seven different inductance values can be obtained.

(1) Between the outer electrodes 13*a* and 13*c*: inductance value of inductor L1

(2) Between the outer electrodes 13*e* and 13*b*: inductance value of inductor L2

(3) Between the outer electrodes 13*c* and 13*e*: inductance value of inductor L3

(4) Between the outer electrodes 13*a* and 13*e*: combined inductance value of inductors L1 and L3

(5) Between the outer electrodes 13*c* and 13*b*: combined inductance value of inductors L2 and L3

(6) Between the outer electrodes 13*a* and 13*c*, and between the outer electrodes 13*e* and 13*b* (when these are connected in series): combined inductance value of inductors L1 and L2

(7) Between the outer electrodes 13*a* and 13*b*: combined inductance value of inductors L1, L2, and L3

As discussed above, like in the electronic component 10*h*, increasing the number of inductors increases the number of combinations of the inductors, thereby increasing the number of obtainable inductance values.

The electronic component 10*h* may include a further larger number of inductors.

Other Embodiments

The electronic components according to the present disclosure are not limited to the aforementioned electronic components 10 and 10*a* to 10*h*, and various modifications can be made within the scope and spirit of the disclosure.

The configurations of the electronic components 10 and 10*a* to 10*h* may be arbitrarily combined.

In the electronic components 10 and 10*a* to 10*f*, a portion between the flange 11*b* and the flange 11*c* may be filled with a resin. Further, in the electronic component 10*g*, a portion between the flange 11*b* and the flange 11*d* may be filled with a resin, and a portion between the flange 11*d* and the flange 11*c* may be filled with a resin. In addition, in the electronic component 10*h*, a portion between the flange 11*b* and the flange 11*d* may be filled with a resin, a portion between the flange 11*d* and the flange 11*e* may be filled with a resin, and a portion between the flange 11*e* and the flange 11*c* may be filled with a resin. Moreover, the resin may include magnetic powder. With this, a closed magnetic circuit is formed in the inductors L1 and L2.

The electronic components 10 and 10*a* to 10*h* may be used in other devices than DC-DC converters. Aside from DC-DC converters, the electronic components 10 and 10*a* to 10*h* may be used in an antenna, used as an inductor for impedance matching, and so on, for example.

In the electronic components 10 and 10*a* to 10*d*, each of the flanges 11*b* and 11*c* may stretch out from the core portion 11*a* toward only one side of the front-rear direction or toward only one side of the right-left direction. Further, in the electronic components 10*e* to 10*h*, each of the flanges 11*b* to 11*d* may stretch out from the core portion 11*a* at least toward the lower side.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An electronic component comprising:

a core including a first flange;

a first outer electrode;

a second outer electrode;

a third outer electrode; and a wire electrically connecting the first outer electrode, the third outer electrode, and the second outer electrode in series in that order, wherein the wire forms a first inductor by being wound on the core between the first outer electrode and the third outer electrode, and also forms a second inductor by being wound on the core between the third outer electrode and the second outer electrode, and the third outer electrode extends across an upper surface of the first flange in a direction from one side edge of the first flange to an opposite side edge of the first flange, and proximate to another side edge of the first flange that extends transverse to the one side edge and the opposite edge.

2. The electronic component according to claim 1, wherein the wire is wound on the core between the first outer electrode and the third outer electrode, and is also wound on the core between the third outer electrode and the second outer electrode.

3. The electronic component according to claim 1, wherein the core includes a core portion extending along a first direction; the first flange that stretches out from the core portion along a second direction orthogonal to the first direction; and a second flange that stretches out from the core portion along the second direction and is provided at a position distanced toward a first side of the first direction relative to the first flange.

4. The electronic component according to claim 3, wherein the first flange includes a first mounting surface positioned on a second side of the first direction, and the first outer electrode, the second outer electrode, and the third outer electrode are provided on the first mounting surface.

5. The electronic component according to claim 3, wherein the first flange and the second flange include a second mounting surface and a third mounting surface, respectively, that are positioned on one side of the second direction, and the first outer electrode, the second outer electrode, and the third outer electrode are provided on the second mounting surface or the third mounting surface.

6. The electronic component according to claim 1, wherein an inductance value of the first inductor and an inductance value of the second inductor are different from each other.

7. The electronic component according to claim 1, wherein the second inductor is wound on the first inductor which is wound on the core, and the number of turns of the second inductor is smaller than the number of turns of the first inductor.

8. The electronic component according to claim 1, wherein the core includes a core portion extending along a first direction, the first flange that stretches out from the core portion along a second direction orthogonal to the first direction, one or more third flanges that stretches out from the core portion along the second direction and is provided at a position distanced toward a first side of the first direction relative to the first flange, and a second flange that stretches out from the core portion along the second direction and is provided at a position distanced toward the first side of the first direction relative to the third flanges, the first flange, the second flange, and the third flanges include a fourth mounting surface, a fifth mounting surface, and a sixth mounting surface, respectively, that are positioned on one side of the second direction, the first outer electrode is provided on the fourth mounting surface, the second outer electrode is provided on the fifth mounting surface, the third outer electrode is provided on the sixth mounting surface, and the wire is wound on a portion of the core portion between the first flange and one of the third flanges between the first outer electrode and the third outer electrode, and is also wound on a portion of the core portion between the second flange and one of the third flanges between the second outer electrode and the third outer electrode.

9. An electronic component comprising:

a core including a first flange;

a first outer electrode on the first flange;

a second outer electrode on the first flange;

a third outer electrode on the first flange; and a wire electrically connecting the first outer electrode, the third outer electrode, and the second outer electrode in series in that order, such that a first portion of the wire connected to the first outer electrode extends over one side edge of the first flange and a second portion of the wire connected to the second outer electrode extends over an opposite side edge of the first flange, and a third portion of the wire connected to the third outer electrode extends over the one side edge of the first flange and the opposite side edge of the first flange;

wherein the wire forms a first inductor by being wound on the core between the first outer electrode and the third outer electrode, and also forms a second inductor by being wound on the core between the third outer electrode and the second outer electrode.

10. The electronic component according to claim 9, wherein the wire is wound on the core between the first outer electrode and the third outer electrode, and is also wound on the core between the third outer electrode and the second outer electrode.

11. The electronic component according to claim 9, wherein the core includes a core portion extending along a first direction; the first flange that stretches out from the core portion along a second direction orthogonal to the first direction; and a second flange that stretches out from the core portion along the second direction and is provided at a position distanced toward a first side of the first direction relative to the first flange.

12. The electronic component according to claim 11, wherein the first flange includes a first mounting surface positioned on a second side of the first direction, and the first outer electrode, the second outer electrode, and the third outer electrode are provided on the first mounting surface.

13. The electronic component according to claim 11, wherein the first flange and the second flange include a second mounting surface and a third mounting surface, respectively, that are positioned on one side of the second direction, and the first outer electrode, the second outer electrode, and the third outer electrode are provided on the second mounting surface or the third mounting surface.

14. The electronic component according to claim 9, wherein an inductance value of the first inductor and an inductance value of the second inductor are different from each other.

15. The electronic component according to claim 9, wherein the second inductor is wound on the first inductor which is wound on the core, and the number of turns of the second inductor is smaller than the number of turns of the first inductor.

16. The electronic component according to claim 9, wherein the core includes a core portion extending along a first direction, the first flange that stretches out from the core portion along a second direction orthogonal to the first direction, one or more third flanges that stretches out from the core portion along the second direction and is provided at a position distanced toward a first side of the first direction relative to the first flange, and a second flange that stretches out from the core portion along the second direction and is provided at a position distanced toward the first side of the first direction relative to the third flanges, the first flange, the second flange, and the third flanges include a fourth mounting surface, a fifth mounting surface, and a sixth mounting surface, respectively, that are positioned on one side of the second direction, the first outer electrode is provided on the fourth mounting surface, the second outer electrode is provided on the fifth mounting surface, the third outer electrode is provided on the sixth mounting surface, and the wire is wound on a portion of the core portion between the first flange and one of the third flanges between the first outer electrode and the third outer electrode, and is also wound on a portion of the core portion between the second flange and one of the third flanges between the second outer electrode and the third outer electrode.

* * * * *